US008011124B1

(12) United States Patent
Temples et al.

(10) Patent No.: US 8,011,124 B1
(45) Date of Patent: Sep. 6, 2011

(54) BRACELET IDENTIFICATION SYSTEM AND METHOD

(75) Inventors: Mary Ann Temples, Keithville, LA (US); Teresa S. Goodin, Lafayette, LA (US)

(73) Assignee: Safe and Secure Legacy, LLC, Lafayette, LA (US)

( * ) Notice: Subject to any disclaimer, the term of this patent is extended or adjusted under 35 U.S.C. 154(b) by 176 days.

(21) Appl. No.: 12/606,554

(22) Filed: Oct. 27, 2009

Related U.S. Application Data

(60) Provisional application No. 61/108,951, filed on Oct. 28, 2008.

(51) Int. Cl.
*A44C 5/00* (2006.01)

(52) U.S. Cl. ..... 40/633; 40/665

(58) Field of Classification Search ..... 40/633, 40/665; 24/16 PB; 63/7, 3.1, 11
See application file for complete search history.

(56) References Cited

U.S. PATENT DOCUMENTS

| | | | | |
|---|---|---|---|---|
| D3,383 | S | 2/1869 | Codding, Jr. | |
| 2,449,181 | A | 9/1948 | Smiley | |
| 2,582,878 | A | 1/1952 | Metcalf | |
| 3,106,028 | A * | 10/1963 | Baumgartner | 40/633 |
| 4,236,280 | A * | 12/1980 | Kreiseder | 24/16 PB |
| 4,311,740 | A | 1/1982 | Kay | |
| 4,377,047 | A * | 3/1983 | Adams et al. | 40/665 |
| 4,499,680 | A * | 2/1985 | Coburn | 40/304 |
| 4,612,718 | A * | 9/1986 | Golub et al. | 40/633 |
| 4,615,185 | A * | 10/1986 | Bollinger | 63/1.13 |
| 4,768,688 | A | 9/1988 | Harrigan | |
| 5,323,554 | A | 6/1994 | MacDonald | |
| 5,343,608 | A | 9/1994 | MacDonald | |
| 5,499,468 | A | 3/1996 | Henry | |
| 5,740,623 | A | 4/1998 | Juhan et al. | |
| 6,388,612 | B1 | 5/2002 | Neher | |
| 6,655,063 | B2 | 12/2003 | Goodin et al. | |
| D505,353 | S | 5/2005 | Del Valle | |
| 6,888,502 | B2 | 5/2005 | Biegel et al. | |
| 6,976,327 | B2 | 12/2005 | Goodin et al. | |
| 7,198,190 | B2 | 4/2007 | Juhan et al. | |
| D558,198 | S | 12/2007 | Blankenship et al. | |
| D562,717 | S | 2/2008 | Gonzales | |
| 7,374,081 | B2 | 5/2008 | Mosher, Jr. | |
| D576,908 | S | 9/2008 | Gruenke | |
| D591,633 | S | 5/2009 | Del Valle | |
| 2004/0098896 | A1 * | 5/2004 | Goodin et al. | 40/633 |
| 2005/0066563 | A1 | 3/2005 | Juhan et al. | |
| 2005/0108912 | A1 * | 5/2005 | Bekker | 40/633 |
| 2009/0031623 | A1 * | 2/2009 | Decker | 47/43 |

* cited by examiner

*Primary Examiner* — Gary Hoge
(74) *Attorney, Agent, or Firm* — Jones Walker

(57) ABSTRACT

A bracelet identification system including a band or bracelet with a locking mechanism that is adjustable, a pocket receptacle for placement of an identification card, and an identification card including an identification number specific to a wearer of the system, a bar code storing additional information about the wearer, a security device, and/or printed information about the wearer.

20 Claims, 5 Drawing Sheets

BRACELET IDENTIFICATION SYSTEM AND METHOD

CROSS-REFERENCE TO RELATED APPLICATIONS

This application claims the benefit of and priority to U.S. Provisional Patent Application No. 61/108,951, filed Oct. 28, 2008.

FIELD OF THE INVENTION

The present invention relates to a bracelet identification system and more particularly to an identification system including a bracelet, a transparent pocket part for placement of an identification card, and an identification card. The identification card may contain an identification number, bar code, security device, and/or printed information.

BACKGROUND OF THE INVENTION

Identification systems such as those used for newborn babies have been in wide spread use in hospitals and other medical facilities. These systems include soft plastic bracelets that fasten to the wrist or ankle via a buttonhole method, or by a metal clamp. Two bracelets are customarily attached to the wrist and ankle of the baby. A third bracelet is attached to the mother's wrist immediately after delivery. All three bracelets are provided with an identical identification number.

Plastic soft bracelets have many disadvantages. They routinely slip off a baby's wrist or ankle a day or two after delivery as the size of the baby's wrists and ankles shrink. With the buttonhole or metal clamp system for attachment, the bracelet is often attached too loosely around the wrist or ankle resulting in the bracelet becoming dislodged from the baby. The bracelet is also many times applied too tightly causing the edges of the bracelet to cut into the delicate skin on the baby's wrist or ankle. With premature babies, the bracelet is simply too large to be used and is taped to the baby's bed until the baby "grows" into the bracelet. The baby is therefore without any identification when removed from the bed.

Baby identification systems have been developed to overcome the disadvantages of the soft plastic bracelet. For example, U.S. Pat. Nos. 6,655,063 and 6,976,327 describe a baby identification system which includes a set of bracelets for placement on the wrist or ankle of the baby and on the wrist of the mother. The bracelet has a pocket portion for placement of an identification card for the baby, a common identification number, a flexible fastening strap connected to the pocket portion, which has a plurality of ratchet teeth thereon and a locking mechanism for receiving and securing the flexible fastening strap. The locking mechanism has a plurality of ridges which are engaged by a cam to enable the fastening strap to be moved in one direction only to tighten the strap about the wrist or ankle and to prevent the strap from being loosened on the wrist or ankle. The disclosure of U.S. Pat. Nos. 6,655,063 and 6,976,327 are each incorporated by reference as if fully set forth herein.

Bracelets have also been used in the past to identify a person's medications. Bracelets have also been used for purposes of security. Traditionally, security bracelets have been large and cumbersome to wear.

There is a need for a more secure, comfortable, and reliable bracelet identification system particularly a system used to identify and protect newborn babies. There is also a need for an identification system that combines multiple functions such as identification, medical information, and security.

SUMMARY OF THE INVENTION

It is an object of the present invention to provide a secure, comfortable, and reliable bracelet identification system particularly a system used to identify and protect newborn babies.

It is a further object of the present invention to provide a bracelet identification system which includes a bracelet that can be tightened according to the size of the wrist or ankle but not over-tightened.

It is a further object of the present invention to provide a bracelet identification system which includes a bracelet having a transparent receptacle for an identification card that affords easy viewing of the card when placed in the receptacle.

It is a further object of the present invention to provide a bracelet identification system which includes an identification card with the capability of containing or storing information about the wearer and/or functioning as a security device.

It is a further object of the present invention to provide a bracelet identification system that combines multiple functions such as identification, medical and/or medication information, and security.

It is a further object of the present invention to provide a bracelet identification system of decreased dimension to facilitate ease and convenience of use.

These and other objects and advantages of the present invention are achieved by the bracelet identification system of the present invention which includes three main components: (1) a band or bracelet with a locking mechanism that is adjustable; (2) a pocket receptacle for placement of an identification card; and (3) an identification card.

The band or bracelet may be a flexible soft tube containing a ratchet based mechanism that can be tightened according to the size of the wearer's wrist or ankle. The ratchet mechanism prevents over-tightening of the bracelet.

The pocket may be detachably affixed to the bracelet. The pocket contains a receptacle for placement of the identification card. The pocket may be transparent so that the identification card may be seen and readily viewable. The pocket also protects the identification card from being exposed to water or other substances that could degrade the card.

The identification card may contain an identification number, a bar code, a security device, and/or printed information. The identification number is personal to the wearer. The bar code may contain stored information about the wearer. In the case where the wearer is a patient in a medical facility, the stored information in the bar code may include the patient's detailed medical history and medications. The security device may be a radio-frequency identification ("RFID") tag, a GPS receiver, or a combined RFID tag/GPS receiver. The security device may be used to track or alert security personnel when the wearer has been removed from a certain area or location. The card may also contain other information, including printed information about the wearer. If the wearer is a newborn baby, the information may include the baby's sex, the name of the baby's father or mother, the name of the hospital, the doctor's name, and time and date of birth.

DETAILED DESCRIPTION OF THE PREFERRED EMBODIMENTS

Figure 1:
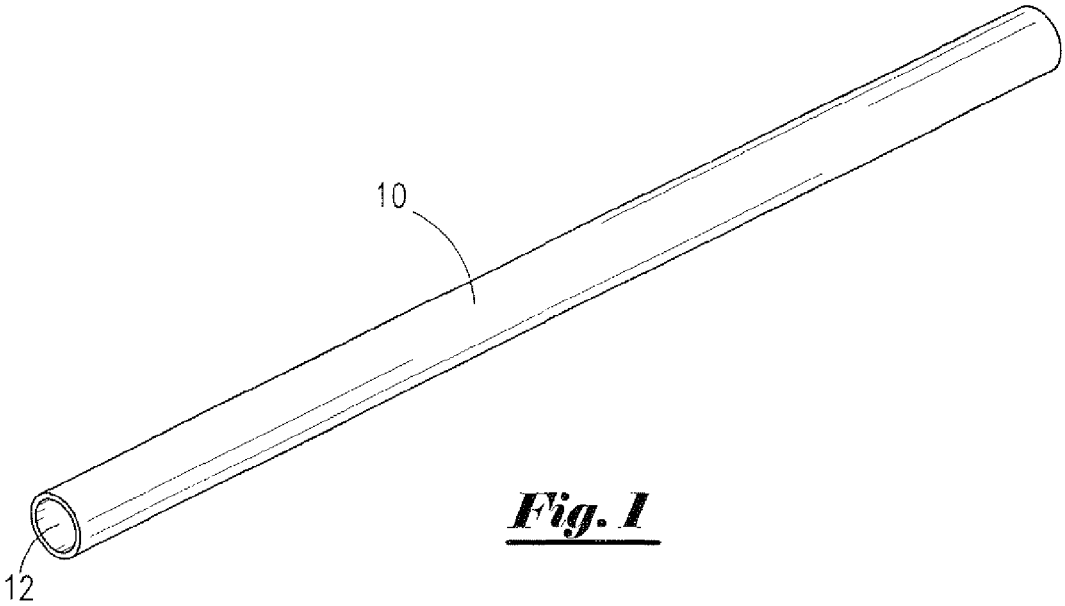
FIG. 1 is a perspective view of the soft tube component of an embodiment of the present invention.
Figure 2:
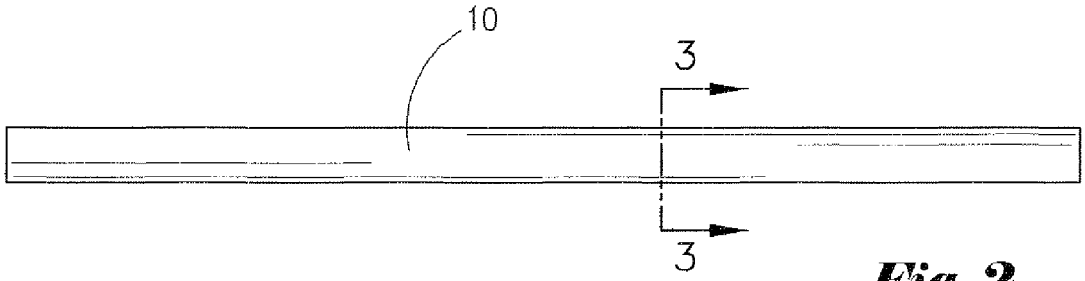
FIG. 2 is a side view of the soft tube component of the embodiment of the present invention shown in FIG. 1.
Figure 3:
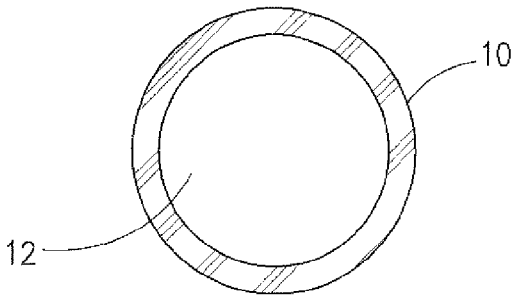
FIG. 3 is a cross-sectional view taken along lines 3-3 of the soft tube component shown in FIG. 2.
Figure 4:
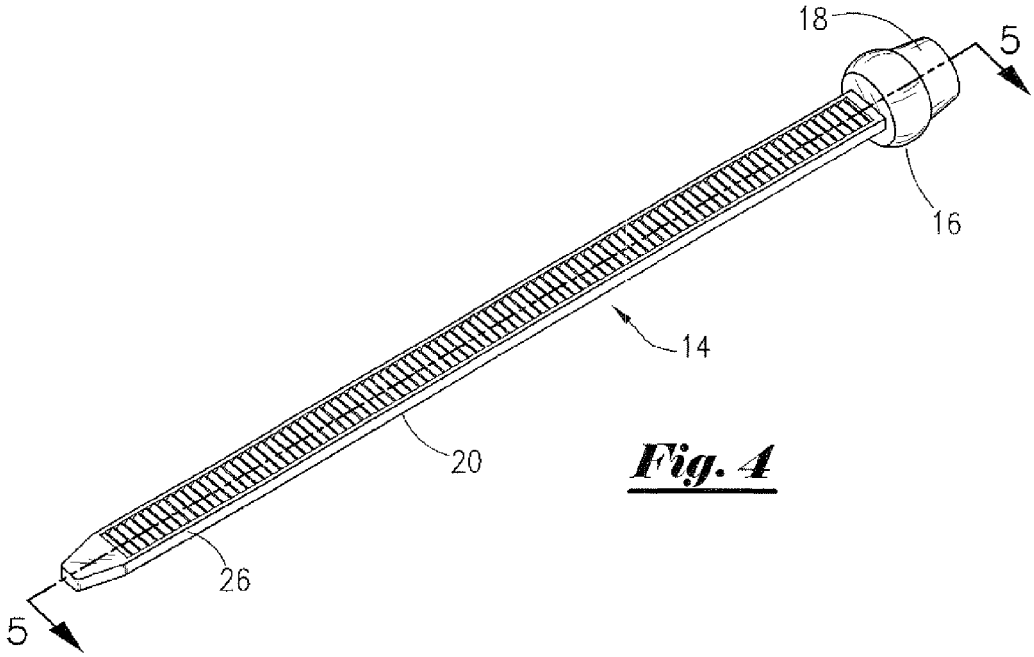
FIG. 4 is a perspective view of the ratchet component of an embodiment of the present invention.
Figure 5:
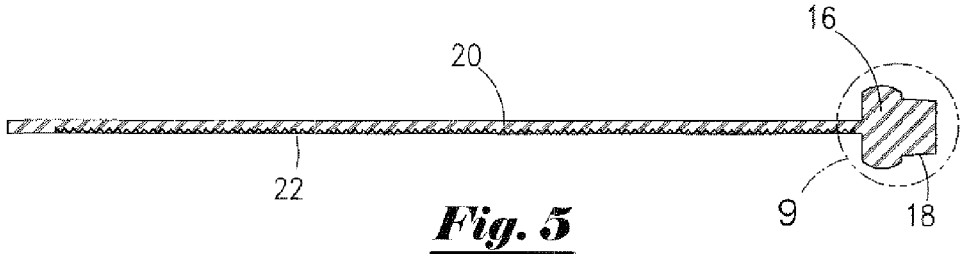
FIG. 5 is a cross-sectional side view taken along lines 5-5 of the ratchet component shown in FIG. 4.
Figure 6:
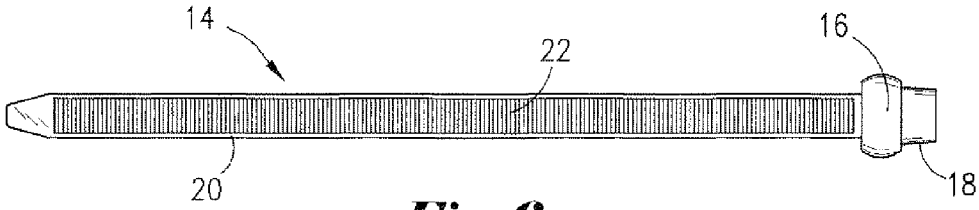
FIG. 6 is a top view of the ratchet component of the embodiment of the present invention shown in FIG. 4.
Figure 7:
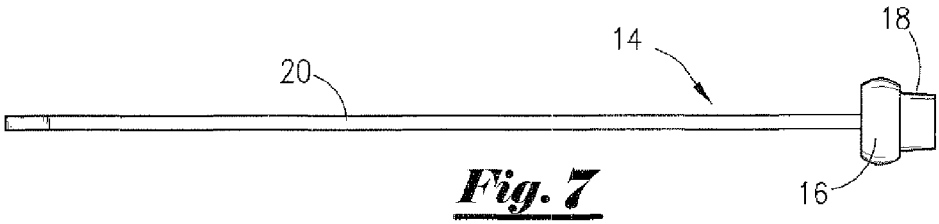
FIG. 7 is a side view of the ratchet component of the embodiment of the present invention shown in FIG. 4.
Figure 8:
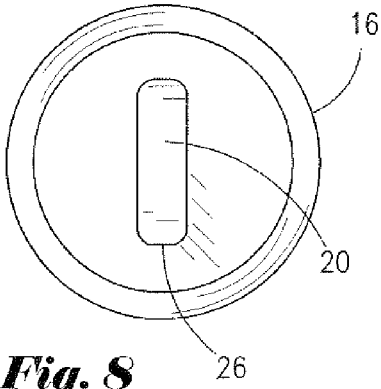
FIG. 8 is a second side view of the ratchet component of the embodiment of the present invention shown in FIG. 4.
Figure 10:
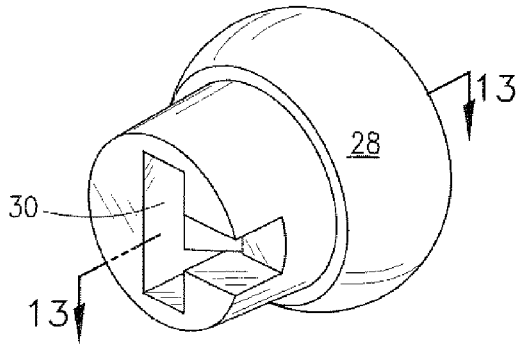
FIG. 10 is a perspective view of the ratchet receiver component of an embodiment of the present invention.
Figure 9:
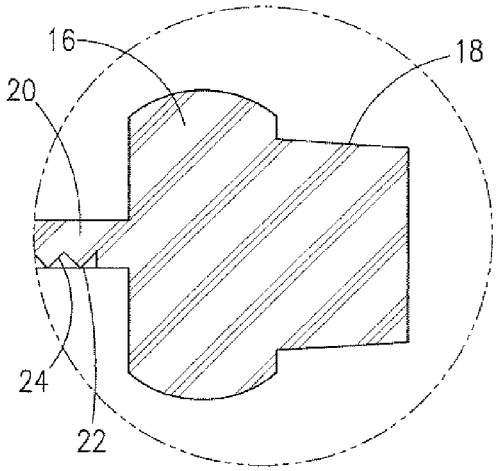
FIG. 9 is a cross-sectional side view of the ratchet head portion of the ratchet component of the embodiment of the present invention shown in FIG. 5.
Figure 11:
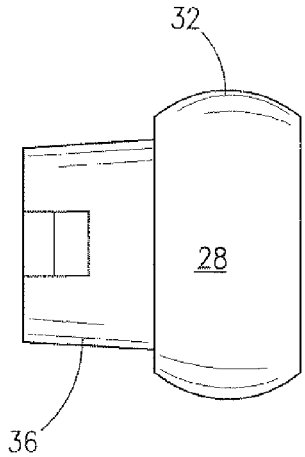
FIG. 11 is a side view of the ratchet receiver component of the embodiment of the present invention shown in FIG. 10.
Figure 12:
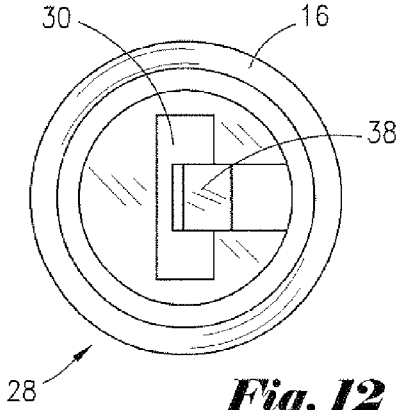
FIG. 12 is a second side view of the ratchet receiver component of the embodiment of the present invention shown in FIG. 10.

With reference to the figures where like elements have been given like numerical designation to facilitate an understanding of the present invention, and in particular with reference to the embodiment of the present invention illustrated in FIG. 18 and FIGS. 1-3, soft tube 10 of identification system 72 may be made of a thermoplastic material that is light weight but durable such as polypropylene. Soft tube 10 may be flexible so that it will easily conform to the shape of a wrist or ankle. Soft tube 10 may be hollow or have a bore 12 extending there-through in order to receive ratchet 14.

Ratchet 14 is illustrated in FIGS. 4-9. Ratchet 14 includes ratchet head 16 at one end with portion 18 that engages and/or is affixed to one end of soft tube 10. Portion 18 of ratchet head 16 may be inserted into bore 12 at one end of soft tube 10 and affixed thereto such as by cement, glue or heat-sealing. Alternatively, ratchet head 16 may be formed integral with the one end of soft tube 10. Longitudinal portion 20 of ratchet 14 extends from ratchet head 16. Longitudinal portion 20 has a surface containing ratchet teeth 22.

Figure 19:
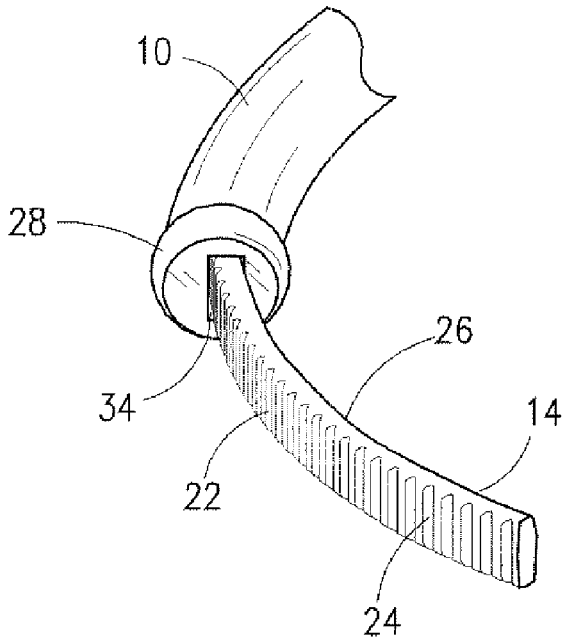
FIG. 19 is partial cut-away perspective view of the ratchet component engaged with the ratchet receiver component and with the ratchet teeth recessed in a groove.

As shown in FIG. 19, teeth 22 may be recessed in groove 24 formed in longitudinal portion 20 so that teeth 22 do not make contact with the skin of the wearer thereby eliminating contact injury to the wearer's such as abrasions. Edge 26 of longitudinal portion 20 is made curved or round so as to not cause skin injury. Skin injury is a concern for newborn babies whose skin is particularly susceptible to abrasions and other injuries. Ratchet 14 may be made of nylon or other similar material.

As revealed in FIGS. 10-13, ratchet receiver 28 contains inner bore 30 designed to receive longitudinal portion 20 of ratchet 14. Ratchet receiver 28 may be circular. Ratchet receiver 28 may have proximal portion 32 containing opening 34 of bore 30 and distal portion 36 that engages with the other end of soft tube 10. Distal portion 36 may be smaller in circumference than proximal portion 32. Distal portion 36 may be inserted into bore 12 of the other end of soft tube 10 and affixed thereto by cement, glue, or heat-sealing. Alternatively, ratchet receiver 28 may be formed integral with the other end of soft tube 10.

Figure 13:
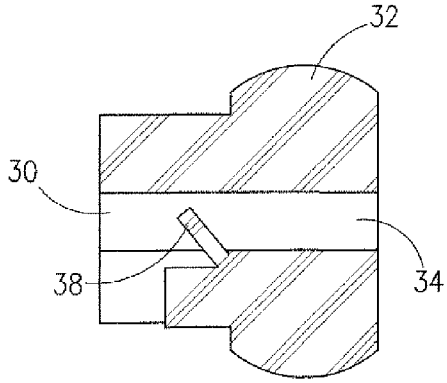
FIG. 13 is a cross-sectional side view taken along lines 13-13 of the ratchet receiver component shown in FIG. 10.

As seen in FIG. 13, angled prong 38 extends into bore 30 of ratchet receiver 28. Prong 38 is flexible and bends when longitudinal portion 20 of ratchet 14 is inserted into and through opening 34. Prong 38 acts as a wedge or brace against ratchet teeth 22 preventing longitudinal portion 20 from retracting from ratchet receiver 28. Ratchet receiver 28 may be made of nylon.

Figure 14:
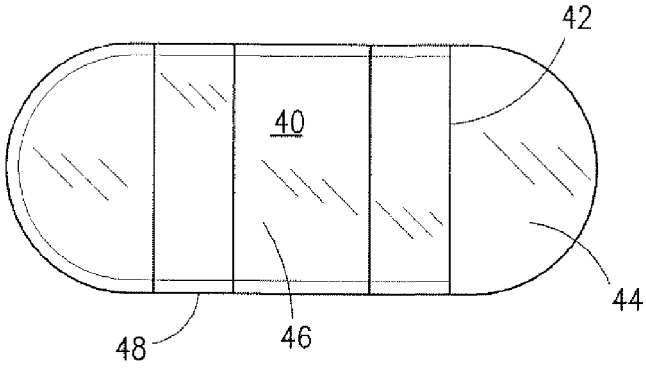
FIG. 14 is a top view of the transparent pocket component of an embodiment of the present invention.
Figure 15:
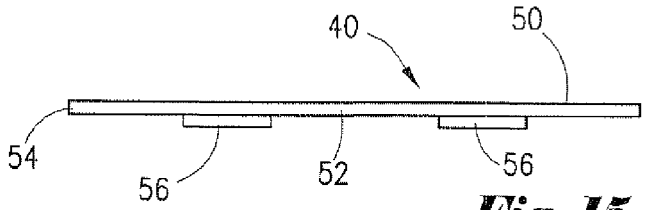
FIG. 15 is a side view of the transparent pocket component of the embodiment of the present invention shown in FIG. 14.

FIGS. 14 and 15 illustrate transparent pocket 40 into which identification card 58 is placed. Pocket 40 may be made of transparent LDPE or low density polyethylene. Pocket 40 contains opening 42 into which identification card 58 may be inserted. Pocket 40 has backing 44. Covering 46 is affixed to side edges 48 of backing 44 (preferably by heat sealing). The combination of backing 44 and covering 46 forms a pouch into which identification card 58 may be placed.

As show in FIG. 15, backing 44 may include top surface 50, bottom surface 52, and interconnecting side surfaces 54. Connecting means 56 may be affixed to bottom surface 52. Connecting means 56 act to connect pocket 40 to soft tube 10. Connecting means 56 may be a tubular band with a bore through which soft tube 10 is inserted. Two or more such bands may be affixed to bottom surface 52 of pocket 40.

Figure 16:
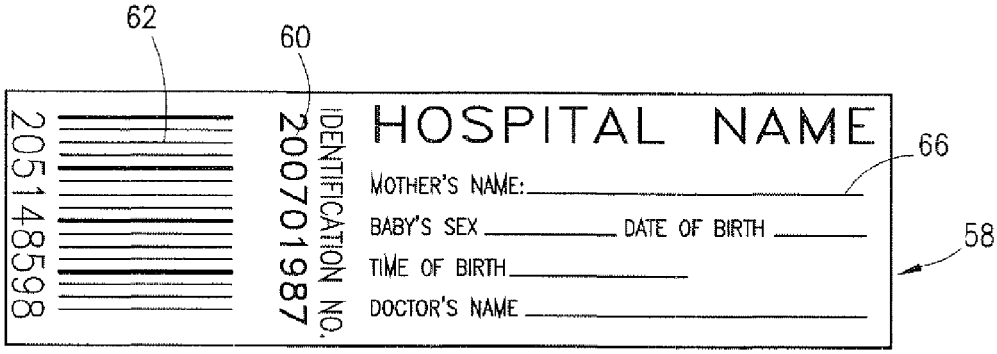
FIG. 16 is a front view of the identification card component of an embodiment of the present invention.
Figure 17:
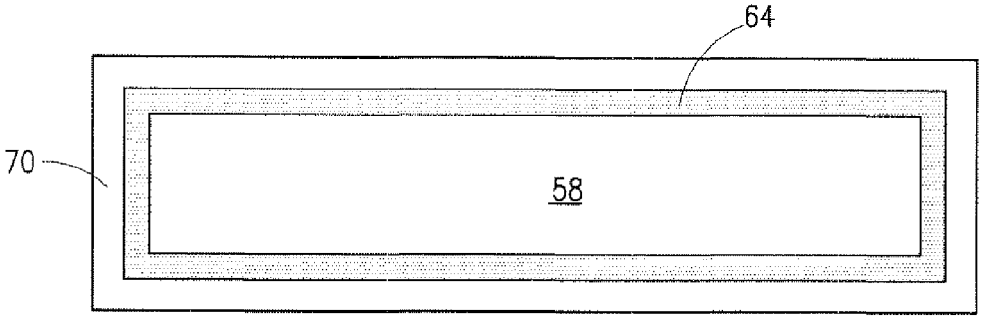
FIG. 17 is a back view of the identification card component of the embodiment of the present invention show in FIG. 16.

With reference to FIGS. 16 and 17, identification card 58 may include identification number 60, bar code 62, security device 64, and printed information 66. Bar code 62 and identification number 60 are used for matching the wearer's bracelet with the bracelet worn by another, e.g., baby and mother. Bar code 62 also permits the storage of extra information such as detailed medical history of the wearer which cannot be printed or hand written on card 58. Other information may appear on card 58 such as additional identification numbers, the wearer's sex, date and time of birth, names of relatives, name of hospital or other location and doctor's name. Bar code 62, identification number 60 and printed information 66 may appear on front face 68 of card 58. Back face 70 of card 58 may include security device 64. Security device 64 may be an RFID tag, which can be detected at the hospital entrance or other specified location and sound an alarm to prevent the wearer from leaving the location. Security device 64 may also be a GPS receiver so that the position of the wearer can be tracked in order to locate and retrieve the wearer. Security device 64 may combine functions. For example, security device 64 may be a combined RFID tag and GPS receiver.

It is to be understood that pocket 40 could be used with an existing identification card or other similar means such as a printed label or sheet. For example, a hospital could use its existing identification printing equipment to prepare the hospital's patient identification label. The label could be placed in pocket 40 or affixed to the outer surface of pocket 40 by adhesive or other affixation means, particularly if the label is self-adhering.

It is also to be understood that identification system 72 may be adaptable to an existing RFID system. For example, an RFID tag in use by a hospital may be incorporated into identification card 58. There would be no need for the hospital to acquire a different or new RFID system.

Figure 18:
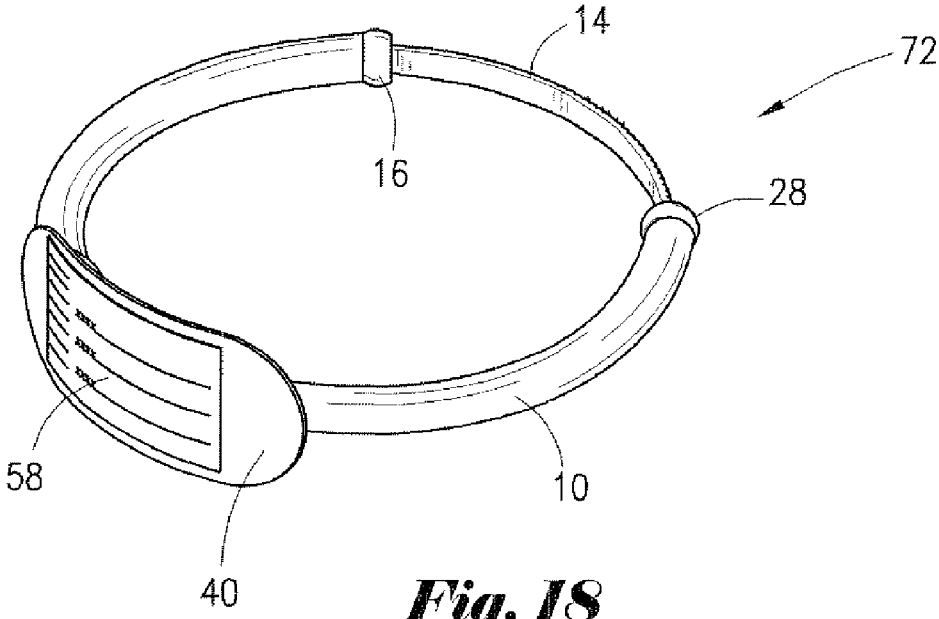
FIG. 18 is a perspective view of an embodiment component of the identification system of the present invention.

FIG. 18 shows identification system 72 in its fully closed position with longitudinal portion 20 of ratchet 14 fully encased within bore 12 of soft tube 10. Pocket 40 is affixed to soft tube 10. Identification card 58 is inserted in pocket 40.

Identification system 72 may be used in a variety of applications or settings where there is a need to identify persons, access info nation about such persons, and/or track or locate such persons. Identification system 72 would have applications for the armed forces, assisted living facilities, amusement parks, hotels and the like. For example, system 72 could be used by hospitals as identification means for babies. It could also be used in stadiums and clubs as a VIP band for customers wishing to be admitted into VIP sections. It could also be used for access control and ticketing for parties or other social functions. It could also be used in a prison system to identify, provide access control and locate prisoners.

Identification system or bracelet 72 may be made in different sizes. For example, bracelet 72 may be sized to fit babies and adults. For babies, bracelet 72 may have a minimum circumference size of 6.6 cm and a maximum circumference size of 13 cm. For an adult, the minimum circumference size may be 15 cm and the maximum circumference size may be 22 cm.

The plastic parts of identification system 72 may be made by injection molding such as heat-injection molding.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A bracelet identification system to be worn about a wrist or ankle of a wearer comprising:

a flexible soft tube having opposite ends, said tube containing an internal bore;

a ratchet having a ratchet head portion and a longitudinally extending portion, said ratchet head portion affixed to one of said ends of said tube, said longitudinally extending portion containing ratchet teeth;

a ratchet receiver having a proximal end, a distal end, and an internal bore running from said proximal end to said distal end, said bore in said proximal end accommodating said longitudinally extending portion of said ratchet, said distal end having a portion affixed to said other end of said tube, said bore in said ratchet receiver communicating with said bore in said tube;

a pocket affixed externally to said tube, said pocket containing a backing and a cover with an opening for insertion and placement of an identification card, said pocket formed of a transparent material; and wherein said identification card includes an identification number specific to said wearer of said system, a bar code storing additional information about said wearer, a security device, printed information about said wearer, or any combination thereof.

2. The system according to claim 1, wherein said ratchet receiver includes a means to engage said ratchet teeth to prevent said ratchet from inadvertently dislodging from said ratchet receiver.

3. The system according to claim 2, wherein said means to engage said ratchet teeth comprises an angled prong.

4. A bracelet identification system to be worn about a wrist or ankle of a wearer comprising:

a flexible soft tube having a first end and a second end, said soft tube containing an internal bore;

a ratchet including a ratchet head and a longitudinal portion, said ratchet head having a connecting portion affixed to said first end of said soft tube, said longitudinal portion containing ratchet teeth;

a ratchet receiver including a proximal end, a distal end and an internal bore extending from said proximal end to said distal end, said distal end having a connecting portion affixed to said second end of said soft tube, said internal bore accommodating said longitudinal portion of said ratchet, said ratchet receiver including a means to engage said ratchet teeth to prevent said ratchet from inadvertently dislodging from said ratchet receiver;

a pocket externally affixed to said soft tube, said pocket including a backing with a top surface, a bottom surface, and interconnecting side surfaces, said top surface having side edges, said pocket including a covering affixed to said top surface of said backing at said side edges to form a pouch for insertion of an identification card;

a means for externally affixing said pocket to said soft tube;

wherein said identification card includes an identification number specific to said wearer of said system, a bar code storing additional information about said wearer, a security device, printed information about said wearer, or any combination thereof.

5. The system according to claim 4, wherein said means to engage said ratchet teeth comprises a flexible angled prong extending into said internal bore of said ratchet receiver.

6. The system according to claim 4, wherein said means for externally affixing said pocket to said soft tube comprises one or more bands affixed to said bottom surface of said backing of said pocket, said one or more bands having a bore through which said soft tube is inserted.

7. The system according to claim 4, wherein said ratchet head is formed integral with said first end of said soft tube.

8. The system in claim 7, wherein said distal end of said ratchet receiver is formed integral with said second end of said soft tube.

9. The system according to claim 4, wherein said longitudinal portion of said ratchet includes a pair of curved side edges interconnected by a groove, said ratchet teeth being recessed within said groove.

10. The system according to claim 4, wherein said security device of said identification card is a radio-frequency identification tag, a global positioning system receiver, or both.

11. The system according to claim 4, wherein said soft tube is composed of a thermoplastic material.

12. The system according to claim 11, wherein said thermoplastic material is a polypropylene.

13. The system according to claim 11, wherein said ratchet and said ratchet receiver are each composed of a nylon.

14. The system according to claim 13, wherein said pocket is composed of a transparent low-density polyethylene.

15. A method of identifying or protecting an individual, comprising the steps of:

a) providing a bracelet identification system comprising: a flexible soft tube having opposite ends, said tube containing an internal bore; a ratchet having a ratchet head portion and a longitudinally extending portion, said ratchet head portion affixed to one of said ends of said tube, said longitudinally extending portion containing ratchet teeth; a ratchet receiver having a proximal end, a distal end, and an internal bore running from said proximal end to said distal end, said bore in said proximal end accommodating said longitudinally extending portion of said ratchet, said distal end having a portion affixed to said other end of said tube, said bore in said ratchet receiver communicating with said bore in said tube, said ratchet receiver including a means to engage said ratchet teeth to prevent said ratchet from inadvertently dislodging from said ratchet receiver; a pocket affixed externally to said tube, said pocket containing a backing and a cover with an opening for insertion and placement of an identification card, said pocket formed of a transparent material; and wherein said identification card includes an identification number specific to said wearer of said system, a bar code storing additional information about said wearer, a security device, printed information about said wearer, or any combination thereof;

b) personalizing said identification card with said identification number specific to said wearer of system, said bar code storing additional information about said wearer, said security device, said printed information about said wearer, or any combination thereof;

c) placing said identification card within said opening of said pocket; and d) attaching said system to said wearer.

16. The method according to claim 15, wherein step (d) includes inserting said longitudinal portion of said ratchet into said internal bore of said ratchet receiver to cause engagement of said ratchet teeth by said means to engage said ratchet teeth to prevent said ratchet from inadvertently dislodging from said ratchet receiver.

17. The method according to claim 16, wherein in step (d) said system is attached to a wrist or ankle of said wearer, the method further comprising the step of: (e) adjusting said system to operatively fit said wrist or ankle by further inserting said longitudinal portion of said ratchet into said internal bore of said ratchet receiver.

18. The method in claim 17, wherein said security device of said identification card is a radio-frequency identification tag, a global positioning system receiver, or both.

19. The method according to claim 18, further comprising the step of: (f) accessing information about said wearer or location of said wearer through said bar code or said security means on said identification card.

20. The method in claim 19, wherein said accessed information is used to identify said wearer, identify information about said wearer, identify a location of said wearer, or any combination thereof.

* * * * *